US006299167B1

(12) United States Patent
Sines et al.

(10) Patent No.: US 6,299,167 B1
(45) **Date of Patent: *Oct. 9, 2001**

(54) PLAYING CARD SHUFFLING MACHINE

(76) Inventors: Randy D. Sines, P.O. Box 30301, Spokane, WA (US) 99223; Steven L. Forte, 315 Francisco St., Henderson, NV (US) 89015; Leonard A. Hale, 17872 Sunshine La., Troup, TX (US) 75789

( * ) Notice: Subject to any disclaimer, the term of this patent is extended or adjusted under 35 U.S.C. 154(b) by 0 days.

This patent is subject to a terminal disclaimer.

(21) Appl. No.: 09/258,835

(22) Filed: Feb. 26, 1999

Related U.S. Application Data

(63) Continuation of application No. 08/847,232, filed on May 1, 1997, now Pat. No. 6,019,368, which is a continuation of application No. 08/228,609, filed on Apr. 18, 1994, now Pat. No. 5,676,372.

(51) Int. Cl.[7] ..... A63F 1/12

(52) U.S. Cl. ..... 273/149 R

(58) Field of Search ..... 273/149 R

(56) References Cited

U.S. PATENT DOCUMENTS

| | | | | |
|---|---|---|---|---|
| 507,930 | | 10/1893 | Ranney | 273/149 R |
| 1,998,690 | | 4/1935 | Shepherd et al. | 273/149 R |
| 2,159,958 | * | 5/1939 | Sachs | 273/149 R |
| 2,747,877 | | 5/1956 | Howard | 273/149 R |
| 4,969,648 | * | 11/1990 | Hollinger et al. | 273/149 R |
| 5,575,475 | | 11/1996 | Steinbach | 273/149 R |
| 5,584,483 | | 12/1996 | Sines et al. | 273/149 R |
| 5,676,372 | | 10/1997 | Sines et al. | 273/149 R |
| 5,692,748 | | 12/1997 | Frisco et al. | 272/149 R |
| 6,019,368 | | 2/2000 | Sines et al. | 274/149 R |

OTHER PUBLICATIONS

International Search Report dated Apr. 10, 2000.

* cited by examiner

*Primary Examiner*—Benjamin H. Layno
(74) *Attorney, Agent, or Firm*—Siemens Patent Services, LC

(57) ABSTRACT

A playing card shuffler for shuffling a stack of playing cards with random distribution. The playing card shuffler includes an infeed playing card stack holder supporting an unshuffled playing card stack and discharges playing cards from incremental positions of the unshuffled playing card stack directly to the shuffled card receiver.

23 Claims, 5 Drawing Sheets

PLAYING CARD SHUFFLING MACHINE

REFERENCE TO RELATED APPLICATIONS

This application is a continuation of application Ser. No. 08/847,232, filed May 1, 1997 now U.S. Pat. No. 6,019,368, issued Feb. 1, 2000, which is a continuation of Ser. No. 08/228,609, filed Apr. 18, 1994, now U.S. Pat. No. 5,676,372, issued Oct. 14, 1997.

BACKGROUND OF THE INVENTION

1. Field of the Invention

The present invention relates to an automatic shuffling machine for shuffling decks of playing cards.

2. Description of the Prior Art

Casinos, cardrooms and other gaming establishments employ many card dealers. The dealers shuffle cards, deal the cards, take bets, and otherwise play the card game. Substantial amounts of the dealers time is spent in just shuffling the decks of cards in preparation for the ensuing card hands. During the time the dealer is shuffling, the game table is inactive and bets are not being placed. From the standpoint of the casino, it is desirable to minimize the time spent in preparing the card decks for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Another problem area suffered by both manual and automated shuffling techniques is associated with having concentrated sequences of cards. These concentrations or "slugs" most often occur with respect to cards having a value of 10, such as in playing blackjack. A skilled card counting gambler can take advantage of such card slugs to turn the odds against the casino and in favor of the card counter. Such slugs also indicate the failure of prior art shufflers to in fact effectively rearrange the order of cards in a deck or decks being shuffled.

Thus there remains a strong need for improved shuffling machines which can effectively reorder a deck or series of decks. Additionally, there remains a need foran improved automatic card shuffler which is relatively easy to build, operate and maintain.

BRIEF DESCRIPTION OF THE DRAWINGS

Preferred embodiments of the invention are described below with reference to the accompanying drawings, which are briefly described below.

FIG. 6 is a schematic diagram showing functional blocks of the control system used in the shuffler of FIG. 1.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
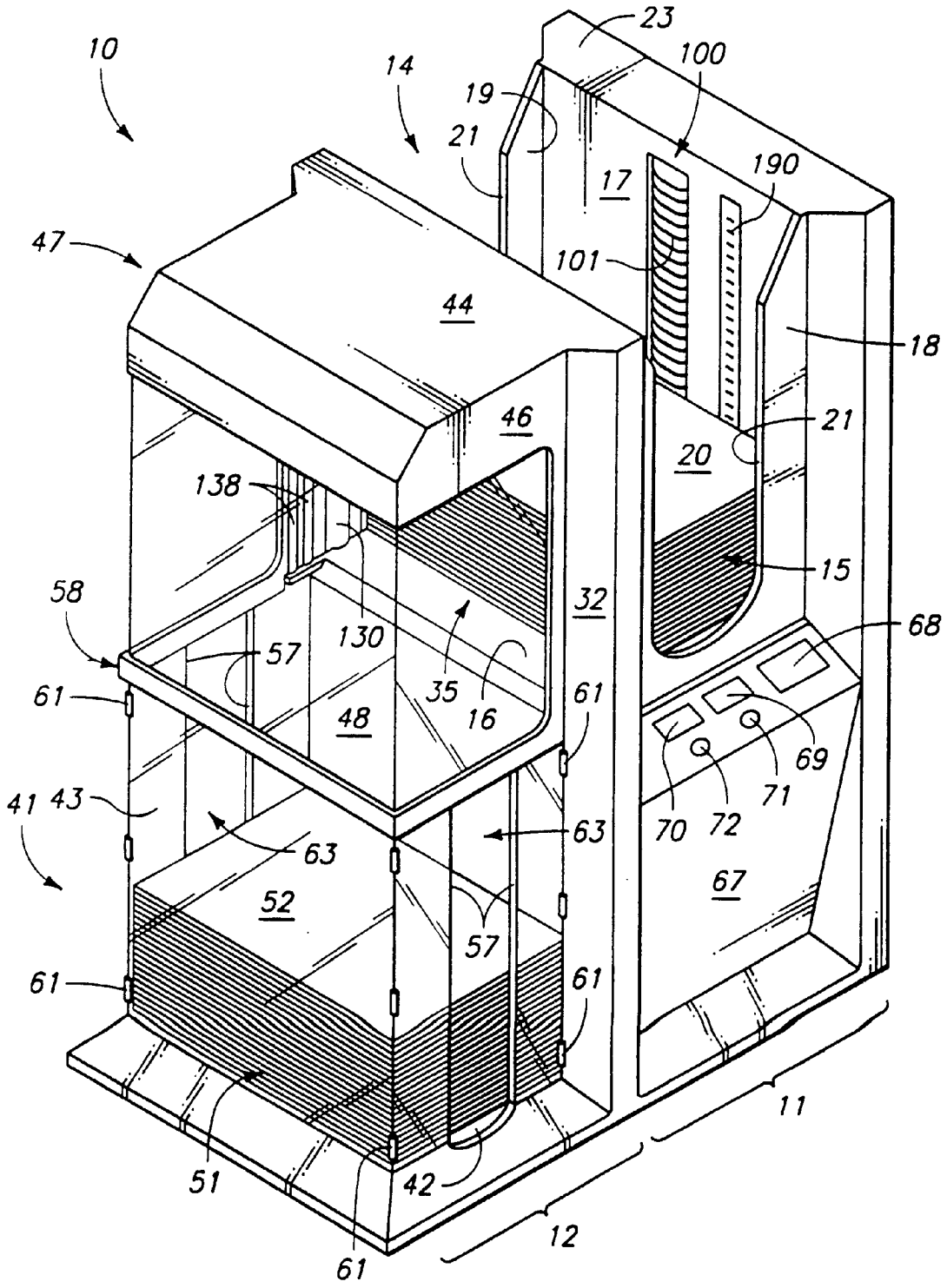
FIG. 1 is a perspective view showing a preferred shuffler according to the invention.

FIG. 1 shows a preferred playing card shuffler 10 built in accordance with the invention. Shuffler 10 includes a first section 11 and a second section 12.

First section 11 includes a first holder 14 for holding a first or infeed stack 15 of playing cards. The first or unshuffled infeed stack holder 14 advantageously includes a bottom 16, ejector or end wall 17, front wall 18, and back wall 19. The front and back walls advantageously include manual access cutouts 21 which are U-shaped openings which open to the top and outside. This construction allows a dealer to more easily place cards 20 into the unshuffled stack holder 14. It also allows manual adjustment of the cards as may be needed in some situations. The openings also allow removal of unshuffled cards from the infeed holder 14 if circumstances justify removal of the stack or other infeed array of playing cards 15.

Ejector or end wall 17 extends from the bottom or floor 16 upwardly to the upper outside surface 23. The inside or intermediate boundary plane 29 is along the opposite or inward side of infeed holder 14, in opposed relationship to end wall 17. The intermediate boundary is relatively open in order to allow unshuffled cards 20 to pass from the first section 11 to the second section 12, as explained more fully below. Upper portions of the shuffler along intermediate boundary 29 include boundary wall portions 30 (FIG. 2) which connect to intermediate pillars and associated wall structures 32. The open central regions of the boundary between the first and second sections form a card transfer aperture 35. Card transfer aperture 35 is defined by bottom or floor 16, boundary wall portions 30, and the distance between rollers 130 (see FIG. 4).

The ejector end wall 17 also preferably mounts an unshuffled infeed stack array playing card detector 190. Detector 190 can be a segmented capacitive detector which senses the capacitance at various longitudinal locations along the infeed stack holder. This information is then used to make an approximate count of remaining cards for purposes of randomly or otherwise selecting a card to be discharged from the remaining cards available within the infeed holder.

The second section 12 includes a second card holder in the form of a shuffled card receiver 41. Shuffled card receiver 41 has a bottom or second section floor 42. An outer or end wall 43 extends upwardly from bottom 42, and connects with a second section top 44. The second section 12 also preferably has a front wall 46 and a back wall 47. Receiver 41 also has an interior wall 48 adjacent to the intermediate or boundary plane 29 between the first and second sections of shuffler 10.

Shuffled card receiver 41 holds an outfeed array 51 in the form of a stack of shuffled playing cards 52. The playing cards rest face-down on floor 42 and are captively positioned between end wall 43, front and back walls 46 and 47, and interior wall 48. The lower portion or zone of the second section forms a collection receptacle forming a part receiver 41. The upper portions of the second section primarily form the upper zone of the shuffled card receiver. The upper and lower zones are approximately divided along the level of floor 16 of the first section.

The shuffled card receiver 41 preferably has continuous walls along the front, back, and outer end of the upper zone to help assure suitable stopping action for playing cards discharged from the first section through opening 35 and into the second section. These upper zone walls are advantageously made from transparent material, such as transparent glass or plastic. A medial frame band 58 extends about the three outer walls approximately along the border between the upper and lower zones of the second section.

The front and back walls of the second section are preferably formed with suitable access doors, such as the opposing dual access doors 56 and 57 shown along the front and back walls, respectively. The dual access doors 56, 57 are hinged, such as by spring biased hinges 61, to adjacent portions of the shuffler frame. The dual access doors 56, 57 shown define open central sections 63 at the front and back. These central openings allow a card dealer to manually grasp shuffled cards 52 and withdraw them through either the front or back sets of dual access doors 56, 57.

FIG. 1 also shows that the first section advantageously has a control panel 67. Control panel 67 can include an on-off switch 68, shuffle start switch 69, and shuffle stop switch 70. Indicator lights 71 and 72 are used to indicate that the shuffler is shuffling or in a stop or completed mode, respectively.

Figure 2:
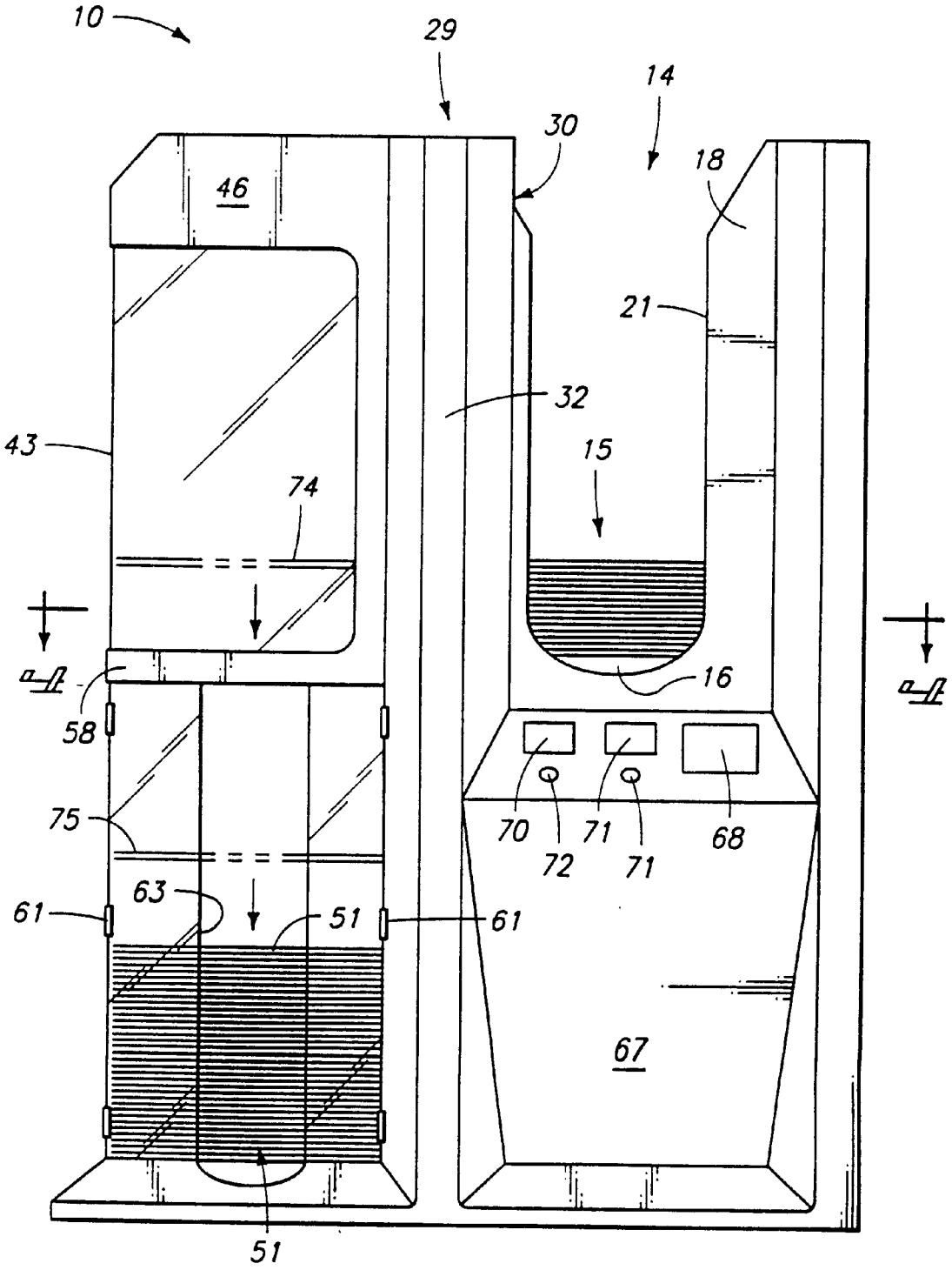
FIG. 2 is a front elevational view of the shuffler shown in FIG. 1.
Figure 3:
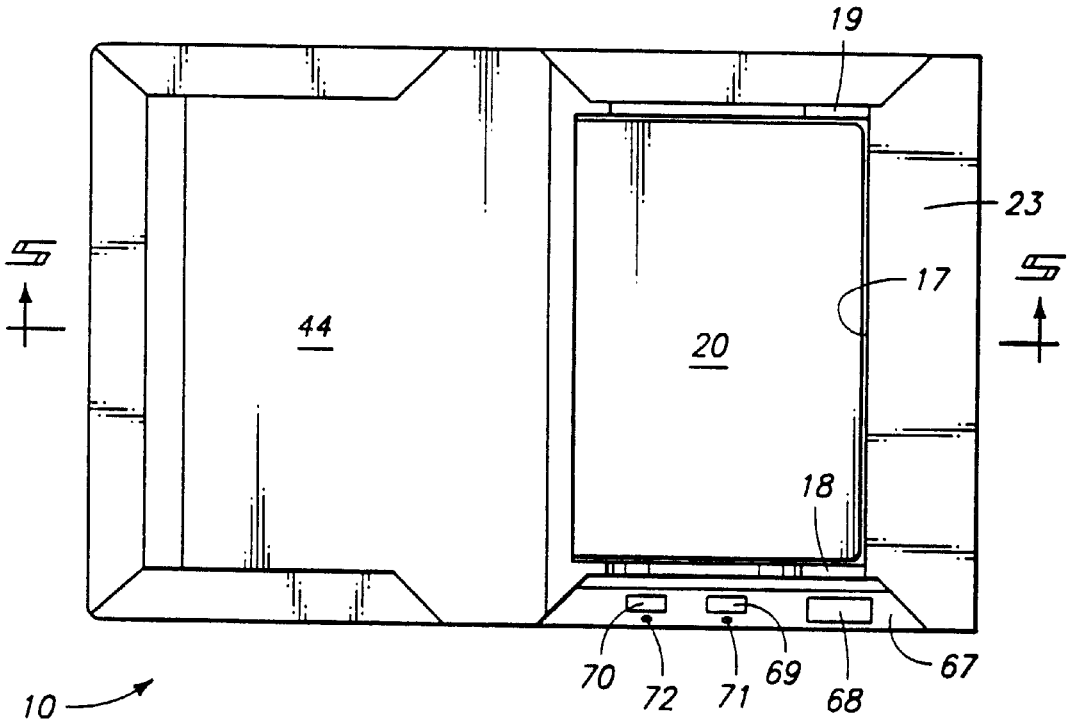
FIG. 3 is a top view of the shuffler shown in FIG. 1.

FIG. 2 shows, in phantom lines, two moving cards 74 and 75. Moving cards 74 and 75 are fed from infeed stack 15 and are discharged laterally into the upper zone of the second section. Card 74 is shown in an upper drift position soon after contact with the second section end wall 43. Card 75 is shown in a second or lower drift position approaching a resting place upon the top of the outfeed stack 51.

Figure 4:
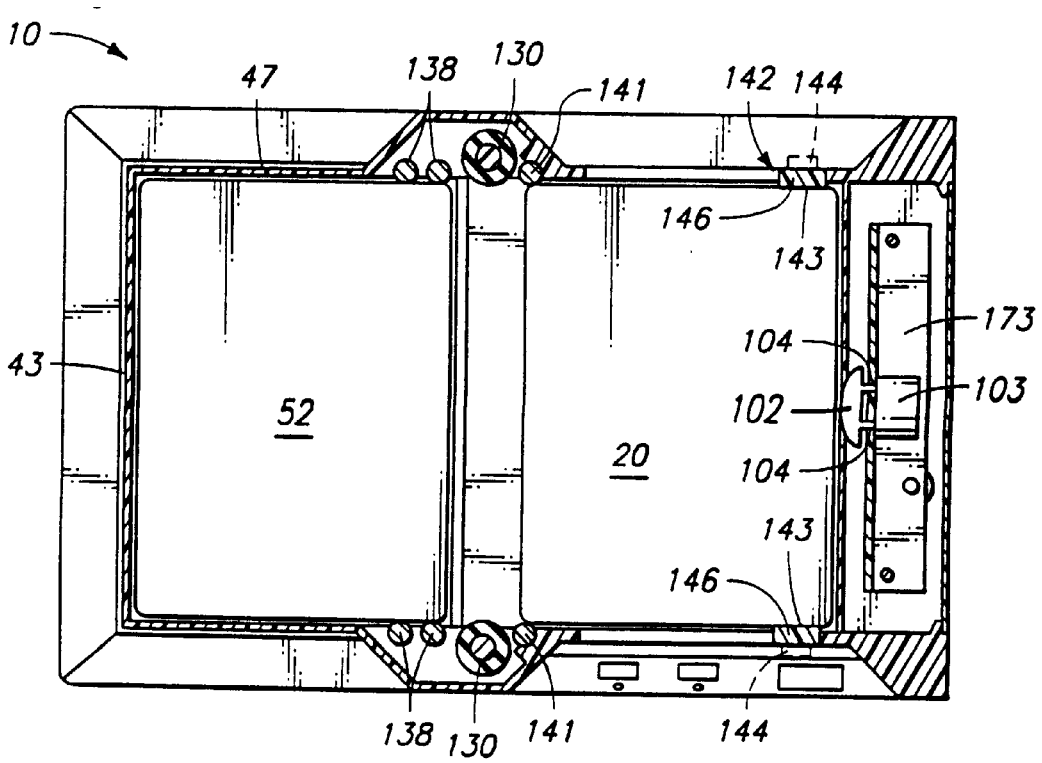
FIG. 4 is a cross-sectional view from a top viewpoint illustrating inner components of the shuffler of FIG. 1.
Figure 5:
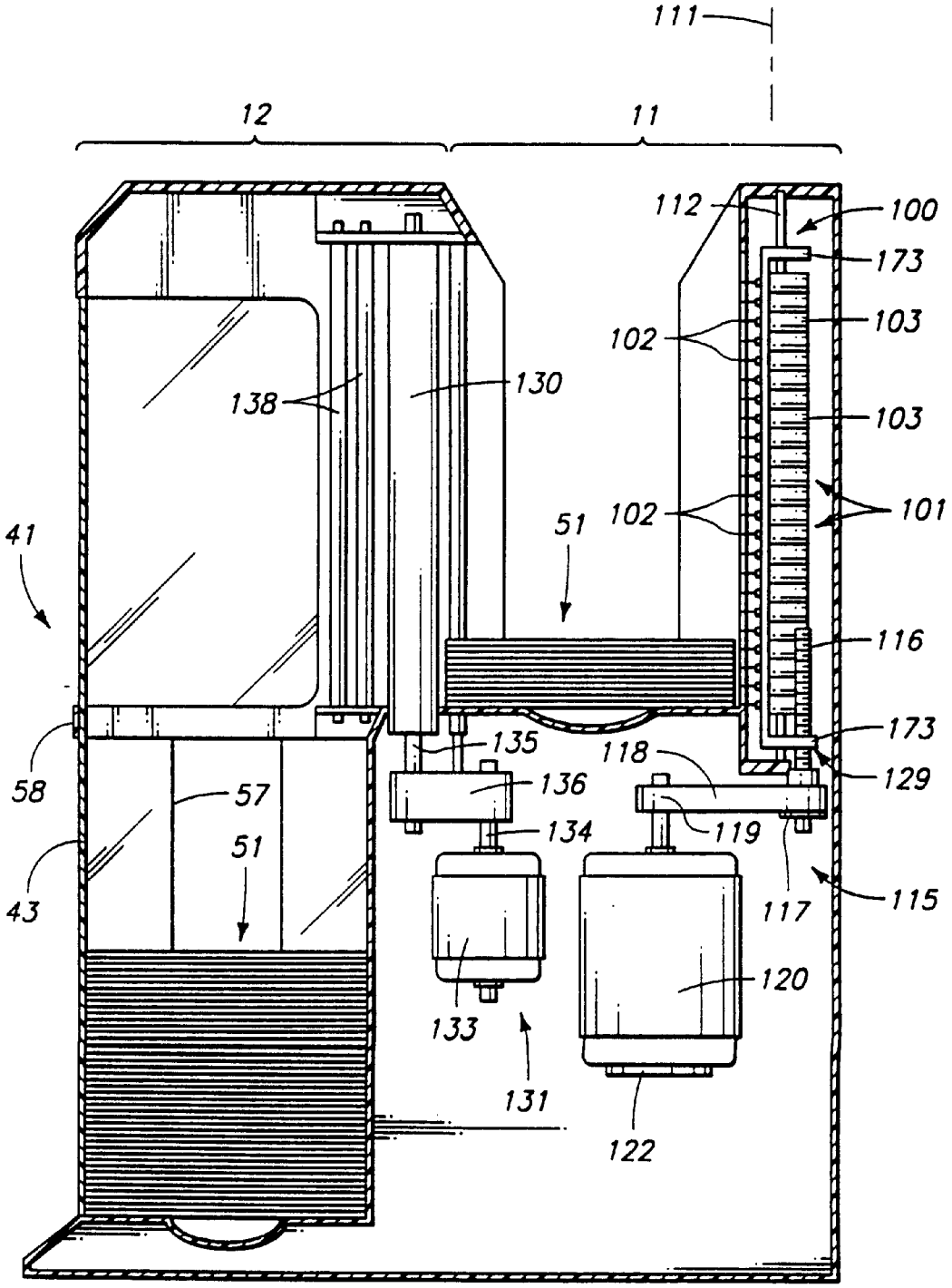
FIG. 5 is a longitudinal sectional view from a front viewpoint illustrating inner components of the shuffler of FIG. 1.
Figure 5:
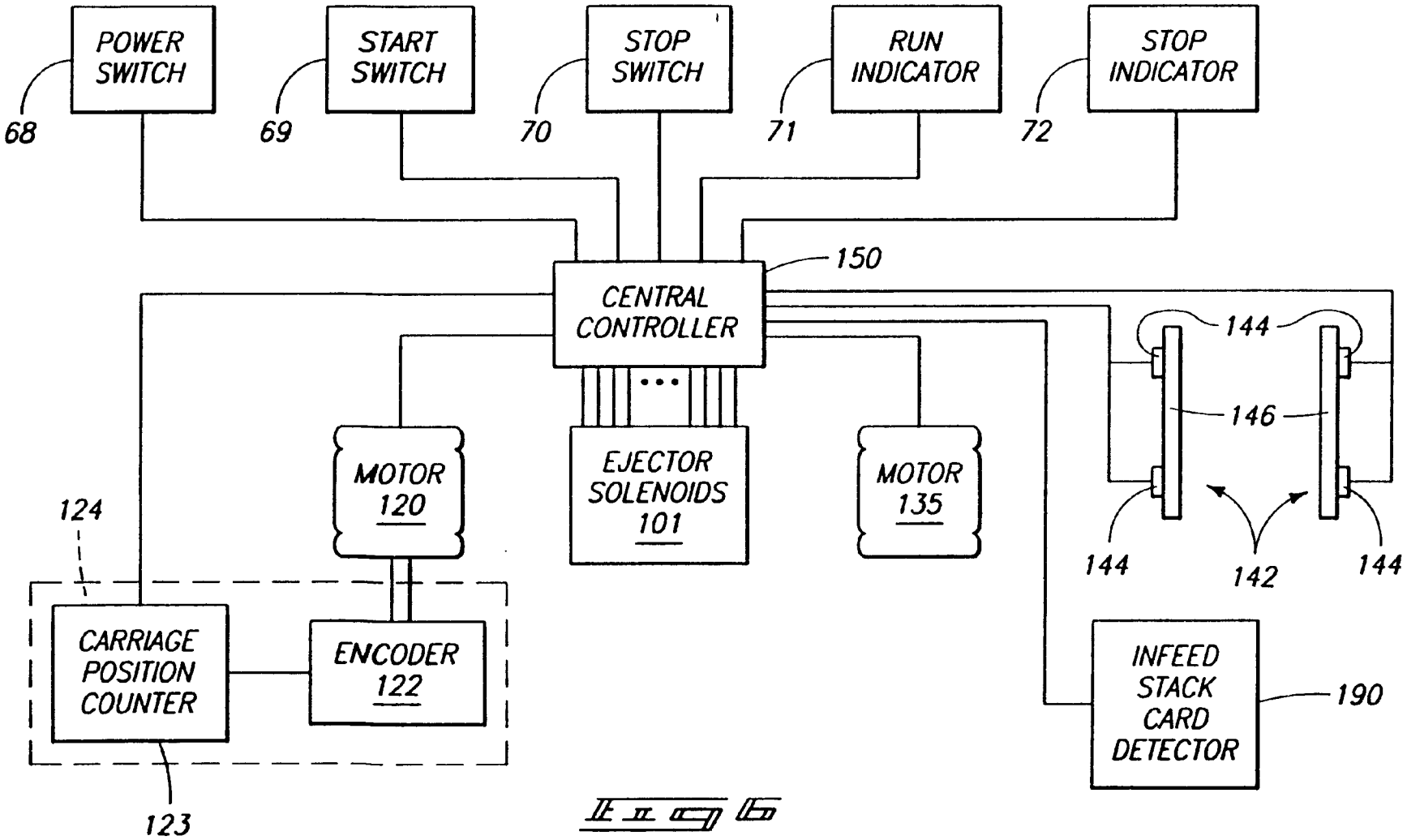

FIGS. 4 and 5 show internal components of card shuffler 10. The shuffler includes at least one discharger which is used to discharge a card 20 from the infeed stack or other infeed array 15. As shown, the discharger includes a plurality of ejectors in the form of an ejection array 100. The ejector array 100 preferably includes a plurality of individual ejector displacers 101. As shown there are twenty three (23) ejector displacers arranged in a vertical ejector displacer array which is sufficiently tall or appropriately spaced to allow ejection of cards from an infeed stack array containing six (6) standard playing card decks. Each deck has fifty two (52) cards, thus providing a maximum infeed array containing 312 playing cards. This provides ejector displacers at an average card spacing of approximately one ejector per twelve (12) cards.

The ejector displacers have ejector displacement heads 102. The ejector displacement heads 102 preferably have an arched or semicircular outer edge or contact face (see FIG. 4). The displacer heads 102 are each connected to an ejector displacer actuator 103. Actuators 103 are mechanically connected to the head using connection bars 104. Actuators 103 are preferably small electrical solenoids which can be activated and deactivated. The solenoids are preferably controlled so that activation causes the ejector displacer heads to extend outwardly into an extended position. In the extended position the head engages and displaces a playing card contained within stack 15. This displacement begins the ejection process. Actuators 103 are also preferably controlled so that deactivation causes the ejector displacer heads to retract. In the retracted position the heads are spaced from the normal position of the infeed card array 15.

FIG. 5 shows that the ejector displacers are preferably mounted upon an ejection carriage 110. Ejection carriage 110 is mounted for controlled movement relative to the infeed stack of cards. More specifically, the ejection carriage is mounted for movement along a carriage axis 111. Carriage axis 111 is defined by two guide rods 112 mounted to the frame of the shuffler. The carriage guide rods are preferably placed at space positions, one toward the front of the shuffler and one toward the back. A carriage frame 173 is constructed and mounted to the guide rods for slidable movement thereon in a direction parallel to the carriage axis 111.

Ejector displacer carriage 110 is provided with a carriage position driver 115 which is used to provide controlled movement of the ejector carriage along the guide rods. Carriage driver 115 includes a drive screw 116 which is threadably received by a screw drive carriage connector secured to carriage frame 173, such as threaded aperture 129. Drive screw 116 is connected for rotation by a drive screw pulley 117. A screw drive belt 118 is trained around pulley 117 and a complementary screw drive primary pulley 119. Screw drive primary pulley 119 is connected to the output shaft of an electrical motor 120 which is the screw drive prime mover.

The screw drive motor 120 is preferably a stepper motor or servo-controlled motor capable of accurate positional control. The drive motor also is preferably provided with an angular encoder 122 which has portion connected to the opposite end of the output shaft. The screw drive encoder 122 generates an accurate digital signal indicative of the angular position of the motor. This encoder information is used with a carriage position counter system 123 (FIG. 6) which after being calibrated indicates the linear position of ejector carriage 110. Data from the resulting carriage position indicator 124 is provided to a central controller 150. Controller 150 is connected to the screw drive motor 120 to provide a control signal which determines the positional change of the motor needed to provide the desired ejector carriage position used in the next ejection step of the shuffler.

The card discharge system of shuffler 10 also preferably includes one or more extractors. As shown, shuffler 10 includes a pair of edge engaging roll extractors 130. Extractor rolls 130 are driven in counterrotationary relationship by an extractor drive 131. Extractor drive 131 includes an extractor drive motor 133 which has a rotational output shaft 134. Output shaft 134 is connected to a counterrotation transmission 136. Transmission 136 is preferably a gear assembly which has two outputs which receive the drive shafts 135 of extractor rolls 130 therein. This construction allows the extractor rolls 130 to be reliably driven at the same angular velocities but in opposite angular directions. The extractor rolls are spaced and positioned so that the rolls engage playing cards displaced by ejector array 101. As shown, the extractor rolls engage the displaced cards along the end edges of the cards. The counterrotationary motion of the extractor rolls pulls the displaced card from the infeed stack to thus complete the card discharge or removal process.

The extraction subsystem is preferably aided by one or more discharge guides. As shown, shuffler 10 is provided with two ancillary guide rollers 138 along both sides. Guide rollers 138 are preferably passive rollers without any drivers but are mounted for free rotation.

FIG. 4 shows that shuffler 10 is also preferably provided with two types of card removal resistors or counters 141 and 142 which resist or counteract removal of cards from the infeed stack. The removal resistors can be static or dynamic. If static then the resistors can simply be elongated resilient pads with faces angled to engage the corners of the discharging cards. Static pad resistors (not shown) can be made from a foam or other suitable material.

As shown, the shuffler includes dynamic removal resistors 141. Dynamic resistors 141 are preferably rotating cylindrical members covered with flailing fibers, such as synthetic nylon bristle fibers. The resistors 141 are mounted adjacent to the forward corners of the infeed stack. Resistors 141 are actively driven in counterrotating directions opposing discharge of cards. The rotational motion is advantageously provided by additional output receptacles formed in gear unit 136. The dynamic resistors serve to help prevent unintended ejection of unselected cards from stack 15. The greatest risk of unintended ejection is associated with the cards adjacent to the card being ejected. This risk of unintended ejection is caused by surface friction between the adjacent card and the card being engaged and displaced by the activated ejector displacer head 102. Some risk also exists that the ejection head 104 may strike two cards.

The removal or ejection resistance subsystem also preferably includes controllable active card removal resistors 142. Removal resistors 142 are mounted along the front and back of the infeed stack holder 14. The active removal resistors 142 include longitudinal strips 146 which preferably have padded contact faces 143 mounted thereon. Padded contact faces 143 engage the edges of the playing cards of the infeed stack. Piezoelectric or other suitable drivers 144 are mounted between the frame of the shuffler and the longitudinal strips 146. The active resistor drivers serve to controllably move the active resistors inwardly and outwardly. When moved inwardly into contracted positions, the co-acting contractionary resistors function to squeeze or grasp the infeed stack. When moved outwardly into expanded positions, the active resistors function to release the cards contained in the infeed stack. The active removal resistors are controlled to engage and grasp the infeed stack during the ejection process in order to reduce the risk of removing multiple cards rather than the single card which is intended to be ejected. Resistors 142 also serve to jostle and straighten the cards of the infeed stack.

FIG. 6 shows a diagrammatic or schematic view of a preferred control system used in shuffler 10. The control system includes a central controller 150 which can be selected from a variety of suitable electronic controllers. Central controller is electrically connected to receive signals from power switch 68, start switch 69, and stop switch 70 on control panel 67. Controller 150 provides signals to run indicator 71, and stop indicator 72 mounted on the control panel 67.

Controller 150 is connected to screw drive motor 120 to provide control signals thereto which indicate action which should be taken by the screw drive to move the ejector carriage 110. Encoder 122 sends signals to carriage position counter. 123, which in turn signals central controller 150 concerning the position of the ejector carriage. Encoder 122 and counter 123 provide a carriage position indicator 124.

Controller 150 is also connected to operate extraction roller drive motor 135. Additionally, controller 150 is connected to the piezoelectric drives 144 for the active resistors 142, to provide intermittent operation thereof as described above. Still further, controller 150 is connected to read the approximate number of cards in the infeed array using the infeed card detector 190.

The invention further includes novel methods for performing automated shuffling of playing cards. The methods include forming an unshuffled array of playing cards which are to be shuffled. The forming of the unshuffled array is advantageously done by forming a stack of playing cards. The forming of the unshuffled array is done in such a manner so as to provide playing cards which are in face-to-back relationships throughout the unshuffled array. Face-to-back relationship refers to the standard condition in which playing cards are sold wherein the face of one card is adjacent to the back of the next adjacent card.

The novel methods further include holding the unshuffled array in an unshuffled array holder. This is advantageously accomplished by holding the infeed stack 15 in the infeed stack holder 14. Holding can further be enhanced by grasping the infeed stack array using the active resistors 142. Such grasping is accomplished by contracting opposing complementary resistors against edges of the playing cards.

The methods further include selectively discharging playing cards from the unshuffled infeed array. The playing cards are discharged from various discharge positions within the array. The discharge positions are most preferably selected in a random fashion from the available array positions left in the stack at the time of discharging.

The selective discharging of playing cards from various positions within the unshuffled card array, also includes selecting a playing card to be discharged. The selecting process is believed capable of being performed under a number of numerical selection processes. It is believed most preferable to perform the card selecting step in a random manner. This random selection is most ideally performed by the central processor 150, appropriately programmed to also perform a random number generation process. The random number generating process is preferably performed in such a manner that the random number is generated with respect to the number of playing cards remaining in the infeed stack. This is determined by the infeed stack array playing card detector 190.

The discharging process is also preferably performed by including an ejecting and displacing of playing cards by extending an ejection head against an edge of the playing card and forcing the card being ejected and displaced. The ejection head performs an inserting action between the playing cards which are adjacent to the card being ejected. The forcing performs a displacing action upon the selected card aligned with the ejection head which was extended.

As shown, the discharging process further preferably includes extracting playing cards from the infeed array. The extracting step is preferably an adjunct to an initial partial ejection or displacement using an activated ejection head 102. Extracting is advantageously accomplished by engaging edges of the selected displaced card using a movable extractor. The step is more preferably accomplished by rolling the edges of the selected card using an extraction roller or rollers. Extraction rolling is most preferably accomplished by rolling the card edges using opposed counterrotating extraction rollers which are rotating at the same angular velocity.

The methods of the invention can further be conducted so as to include guiding the card being discharged. The guiding action can be performed by the passive guide rollers 138 and driver extraction rollers 130.

The novel methods further include receiving discharged playing cards in a shuffled card receiver. This is preferably accomplished by discharging the cards against a stop or rebound surface to perform a stopping and aligning functions. This causes the discharged cards to effectively stop at a desired horizontal position. The discharged playing cards also preferably function by dropping within a shuffled card receiver to form shuffled card stack array 51.

The methods of this invention can further include removing shuffled playing cards from the shuffled card array by removing such cards from the receiver 41. In shuffler 10, this is done by manually grasping a group of cards contained in the outfeed stack and withdrawing them through the opening defined by swinging doors 56 and 57.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for automating shuffling of playing cards, comprising the steps of:

a) forming an unshuffled stack of playing cards which are to be shuffled, said playing cards being in stacked array formation with contact between adjacent cards of the unshuffled array;

b) holding the unshuffled stack in an unshuffled stack holder on a floor having a fixed height; and d) using an ejector mounted on an ejector carriage which is movable relative to a frame to eject at least one playing card at an incremental position of the unshuffled stack directly to a shuffled card receiver to provide a randomly distributed array of shuffled cards.

2. The method of shuffling an array of playing cards according to claim 1, comprising the additional step of collecting the distributed array of shuffled cards in a shuffled card stack.

3. The method of shuffling an array of playing cards according to claim 1, wherein the unshuffled playing cards are discharged one at a time from the unshuffled stack of playing cards.

4. The method of shuffling an array of playing cards according to claim 1, wherein the unshuffled playing cards are discharged in packets of predetermined quantities from the unshuffled array of playing cards.

5. The method of shuffling an array of playing cards according to claim 4, wherein the unshuffled playing cards are discharged in packets of about 12 cards from the unshuffled stack of playing cards.

6. The method of shuffling an array of playing cards according to claim 1, further comprising the step of resisting discharge of playing cards by providing counteractive force opposing discharge of playing cards from the unshuffled stack of playing cards.

7. The method of shuffling an array of playing cards according to claim 1, further comprising the step of resisting discharge of playing cards by engaging the cards with at least one resilient member.

8. The method of shuffling an array of playing cards according to claim 1, further comprising the step of straightening playing cards held in the unshuffled stack array.

9. The method of shuffling an array of playing cards according to claim 1, further comprising the step of detecting the approximate number of cards held in the unshuffled card stack.

10. A method for automated shuffling of playing cards, comprising the steps of:

a) forming an unshuffled stack of playing cards which are to be shuffled, said playing cards being stacked in array formation with contact between adjacent cards;

b) holding the unshuffled stack in an unshuffled stack holder on a floor having a fixed height; and c) using an ejector mounted on an ejector carriage which, is movable relative to a frame, to discharge at least one playing card at a time at a card discharge position of the unshuffled stack directly to a shuffled card receiver for random distribution of the at least one playing card among other playing cards to be received in the shuffled card receiver.

11. The method of shuffling an array of playing cards according to claim 10, comprising the additional step of forming a shuffled card stack from the cards received in the shuffled card receiver.

12. The method of shuffling an array of playing cards according to claim 11, wherein the unshuffled playing cards are discharged one at a time from the unshuffled stack of playing cards.

13. The method of shuffling an array of playing cards according to claim 11, wherein the unshuffled playing cards are discharged in packets of predetermined quantities from the unshuffled array of playing cards.

14. The method of shuffling an array of playing cards according to claim 13, further comprising the step of resisting discharge of playing cards by engaging the cards with at least one resilient member.

15. The method of shuffling an array of playing cards according to claim 13, further comprising the step of straightening playing cards held in the unshuffled stack array.

16. The method of shuffling an array of playing cards according to claim 13, further comprising the step of detecting the approximate number of cards held in the unshuffled card stack.

17. The method of shuffling an array of playing cards according to claim 10, wherein the unshuffled playing cards are discharged in packets of about 12 cards from the unshuffled stack of playing cards.

18. An automated playing card shuffler, comprising:

a) a shuffled stack receiver;

b) a playing card discharger comprising an ejector mounted on an ejector carriage which is movable relative to a frame for discharging playing cards laterally from incremental positions of the unshuffled card stack directly to the shuffled card receiver.

19. The automated playing card shuffler of claim 18, further comprising at least one removal resistor which provides counteractive force opposing displacement of playing cards.

20. The automated playing card shuffler of claim 18, further comprising at least one controllable activated removal resistor which provides controlled intermittent counteractive force opposing displacement of playing cards.

21. The automated playing card shuffler of claim 18, further comprising at least one removal resistor which provides counteractive force opposing displacement of playing cards; said at least one removal resistor including resilient members which engage cards displaced from the unshuffled stack.

22. A method for creating a random deck of shuffled cards, the method comprising the steps of:

a) supporting an array of unshuffled cards on an unshuffled card surface; and b) removing cards from the array of unshuffled cards using an ejector mounted on an ejector carriage which is movable relative to a frame and adjacent the array of unshuffled cards to elect at least one card therefrom, thereby moving cards from the unshuffled array to a shuffled array of cards, the shuffled array of cards having a random array, the shuffled array of cards being supported on a shuffled card surface directly adjacent the unshuffled card surface.

23. The method for reading a random deck of shuffled cards according to claim 22, wherein the cards are playing cards.

* * * * *